US005289981A

United States Patent [19]

Kamiwano et al.

[11] Patent Number: 5,289,981

[45] Date of Patent: Mar. 1, 1994

[54] CONTINUOUS DISPERSING APPARATUS

[75] Inventors: Mitsuo Kamiwano, Yokohama; Yoshitaka Inoue, Tokyo, both of Japan

[73] Assignee: Inoue Mfg. Inc., Japan

[21] Appl. No.: 60,473

[22] Filed: May 7, 1993

Related U.S. Application Data

[63] Continuation of Ser. No. 705,301, May 24, 1991, abandoned.

[51] Int. Cl.[5] ..... B02C 7/04

[52] U.S. Cl. ..... 241/261.1; 241/259.1

[58] Field of Search ..... 241/163, 166, 167, 244, 241/245, 259.1, 259.2, 161.1, 293

[56] References Cited

U.S. PATENT DOCUMENTS

| | | | |
|---|---|---|---|
| 1,009,520 | 11/1911 | Hunt | 241/293 X |
| 1,971,335 | 8/1934 | Benner et al. | 241/261.1 X |
| 3,102,694 | 9/1963 | Frenkel | 241/259.1 X |
| 4,059,232 | 11/1977 | Engles | 241/67 X |
| 4,469,284 | 9/1984 | Brubaker et al. | 241/261.1 X |

*Primary Examiner*—Douglas D. Watts
*Attorney, Agent, or Firm*—Pruce I. Adams; Van C. Wilks

[57] ABSTRACT

A continuous dispersing and grinding apparatus comprises a vessel having an inlet for feeding a material to be processed at one end and an outlet for discharging the processed material at the other end. A rotor is disposed rotatably within the vessel, and the material flows between the vessel and rotor from the inlet towards the outlet. The outer surface of the rotor is provided continuously with an undulations having alternate crests and troughs. The undulations define a repeating succession of distinct sections, namely, a compressing section for gradually compressing the material, a shearing section for applying shearing forces to the material, and an expanding section for releasing the compression of the material. As the material flows through the vessel in the space between the vessel inner wall and the rotor outer surface, the succession of compressing, shearing and expanding sections repeatedly subject the material to compressing, shearing and expanding actions whereby the material is uniformly dispersed and ground.

17 Claims, 3 Drawing Sheets

CONTINUOUS DISPERSING APPARATUS

This is a continuation of parent application Ser. No. 705,301 filed May 24, 1991 now abandoned.

BACKGROUND OF THE INVENTION (1) Field of the Invention

The present invention relates to a continuous dispersing apparatus for mixing, finely grinding and dispersing a material to be processed.

(2) Background Information

As an apparatus for mixing, finely grinding and dispersing material to be processed, roll mills have been generally employed. A triple roll mill, which has been conventionally used as a roll mill, has a set of three rolls. The material is placed between a back roll and a middle roll and mixed by rotating both rolls. A front roll is positioned adjacent to the middle roll and the treated material is transferred from the middle roll to the front roll. The treated material is then scraped off and collected at the front roll.

According to the roll mill method, the material to be processed is dispersed by subjecting it to compressing-shearing-expanding actions through gaps or nips between the back and middle rolls and between the middle and front rolls. The compressing-shearing-expanding actions by means of the roll mill are conducted only at straight sections between two nips among the three rolls and thus the dispersion efficiency of these actions is low.

When the material to be processed is a high viscosity substance, if the gap between the rolls is very small at the beginning of the operation, the start of the rolls is difficult and metal parts may come into contact with each other and cause seizing, and the like.

In addition, since a conventional roll mill is of the batch type, it can not be operated continuously. A conventional roll mill is also generally open to the atmosphere allowing for the release of solvent vapor, etc. Further, the material is cooled only from the inside of the roll, and therefore can not be cooled efficiently.

Another known apparatus is a wet-type medium dispersing apparatus in which grinding elements such as balls, beads, etc. are stirred with a material to be processed in a vessel and shearing forces are applied to the material to be processed to disperse the material. However, the use of such grinding elements has the drawback that fragments or pieces of the grinding elements are often intermixed with the processed material discharged from the apparatus. Also, the structure of the apparatus is complex, and the processing is often difficult.

SUMMARY OF THE INVENTION

An object of the present invention is to provide a continuous dispersing apparatus which does not use the conventional roll mill and which enables continuous treatment by mixing, grinding and dispersing of the material.

Another object of the present invention is to provide a continuous dispersing apparatus which can enhance the dispersing efficiency without using a grinding medium.

According to the present invention, the abovementioned objects can be accomplished by a continuous dispersing apparatus which comprises a vessel having an inlet at an upstream end for admitting a material to be processed and an outlet at a downstream end for discharging the processed material. A rotor is rotatably disposed within the vessel and spaced from the inner wall of the vessel to define therebetween a flow path for the material. The surface of the rotor is provided continuously with undulations having alternate crests and troughs which define a repeating pattern of compressing-shearing-expanding sections. Each compressing section is configured in such a manner that the space between the compressing section and the inner wall of the vessel becomes narrower gradually so that the material may be compressed as it flows past the compressing section from the inlet to the outlet through the path between the rotor and the vessel. Each shearing section is located downstream of a compressing section and opposite to the inner wall with a narrow space therebetween so that shearing forces may be applied to the material between the shearing section and the inner wall. Each expanding section is located downstream of a shearing section and configured in such a manner that the space between the expanding section and the inner wall becomes wider gradually so that the compression to the material may be released downstream of the shearing section.

Other objects and features of the present invention will become apparent to those skilled in the art upon reading the following description with reference to the accompanying drawings.

DESCRIPTION OF THE PREFERRED EMBODIMENTS

Figure 1:
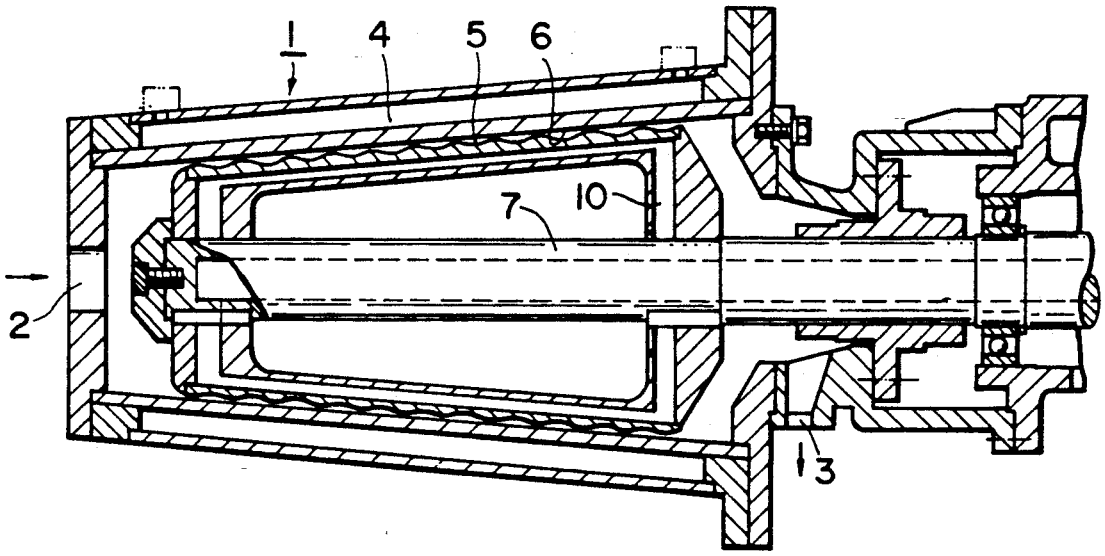
FIG. 1 is a vertical sectional view of one embodiment of a continuous dispersing apparatus according to the present invention.

In FIG. 1, a casing which constitutes a vessel 1 is formed into a cone shape, but may also be formed into a cylindrical shape. The casing has an inlet 2 at one end for admitting a material to be processed and an outlet 3 at the other end for discharging the processed material. At the inlet section, a compressing-feeding means, such as a pump or the like (not shown), is mounted for feeding the material to be processed into the vessel. Around the vessel, a heat-exchange jacket 4 is mounted for circulating a temperature-controlling medium such as cooling water or the like. A rotor 5 is rotatably disposed inside the vessel 1 and is supported by a rotationally driven shaft 7 in such a manner that the rotor 5 may be rotated in close proximity to an inner wall 6 of the vessel 1. It is preferable to apply an axial force to the rotating shaft 7 by use of a force-applying means, such as a spring or the like (not shown), so that the rotor 5 applies a thrust in the direction opposite to the flow direction of the material being processed. The rotor 5 is formed into a substantially cylindrical shape, but may be formed into a polygonal column shape.

Figure 2:
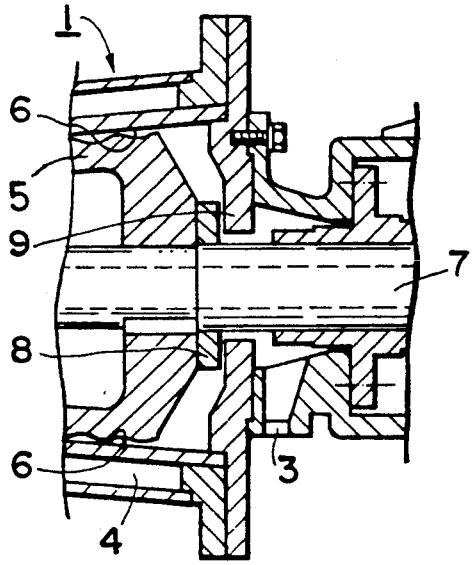
FIG. 2 is a vertical sectional view of a part of another embodiment at an outlet section of a vessel of the continuous dispersing apparatus according to the present invention.

Between the rotor 5 and the inner wall 6 of the vessel, a flow path is formed for flowing the material to be processed. As shown in FIG. 2, a rotor plate 8 and a stator plate 9 may be provided at the downstream end of the flow path to form a narrow gap for preventing the free outflow of the material being processed and for applying sufficient compression to the material.

Also, as shown by chain line in FIG. 1, the rotary shaft 7 may be provided with a flow path at the center portion thereof and a circulating path 10 running through the flow path and the inner wall 6 of the rotor so that a temperature-controlling medium such as cooling water or the like may be passed through the circulating path 10.

Figure 3:
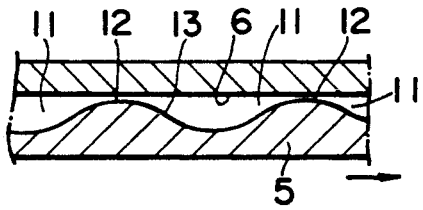
FIG. 3 is a developed view of a surface of a rotor of the continuous dispersing apparatus according to the present invention.

The peripheral surface of the rotor 5, as shown in FIG. 3, is provided with undulations having alternate crests and troughs. The undulations define a repeating succession of distinct sections, namely, a compressing section 11, a shearing section 12 and an expanding section 13. The compressing sections 11 are formed between the troughs and crests of the undulations and slope gradually toward the vessel inner wall 6 in such a manner that the space between the compressing sections 11 and the inner wall 6 of the vessel 1 becomes narrower gradually so that the material to be processed is gradually compressed as the material to be processed is advanced in the direction of the arrow past the compressing sections. The shearing sections 12 are formed at the crests of the undulations and disposed oppositely to the inner wall 6 with a narrow space therebetween so that shearing forces are applied to the material to be processed between the shearing sections 12 and the inner wall 6. The expanding sections 13 are formed between the crests and troughs of the undulations and slope gradually away from the vessel inner wall 6 in such a manner that the space between the expanding sections 13 and the inner wall 6 becomes wider gradually so that the compression imparted to the material is relieved or released immediately downstream of the shearing sections 12.

The undulations defining the compressing section 11, shearing section 12 and expanding section 13 can be variously provided along the direction of transfer of the material to be processed. In the embodiment shown in FIG. 1, the rotor 5 has a compressing section, a shearing section and an expanding section continuously in the axial direction. In this embodiment, the compressing section and expanding section jointly form a hollow or annular groove between each two adjacent shearing sections.

Figure 4:
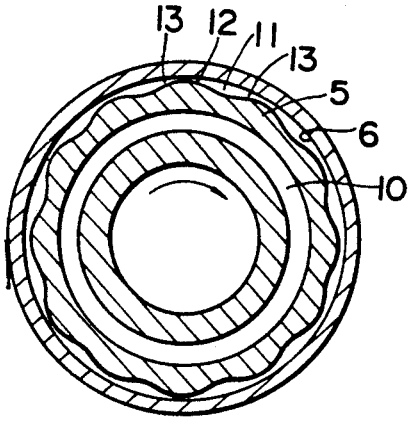
FIG. 4 is a cross-sectional view of another embodiment of the rotor.

The undulations defining the compressing section 11, shearing section 12 and expanding section 13 may be provided continuously in the circumferential direction of the rotor 5, as shown in FIG. 4. In this instance, the compressing section and expanding section form an axial groove in the axial direction of the rotor. These shapes may be formed in the axial direction and circumferential direction in combination to form the compressing section, shearing section and expanding section into a protrusion shape.

The undulations defining the compressing section, shearing section and expanding section may be provided helically around the peripheral face of the rotor. In this instance, the twist direction of the helical pattern is preferably formed in such a direction that the material to be processed is returned back to the inlet side when the rotor is rotated.

The space between the shearing section 12 and the inner wall 6 of the vessel, which is appropriately determined depending on the size of the material to be processed and conditions of the desired products, is mainly preferably within the range of from 0.5 to 0.02 mm.

Figure 5:
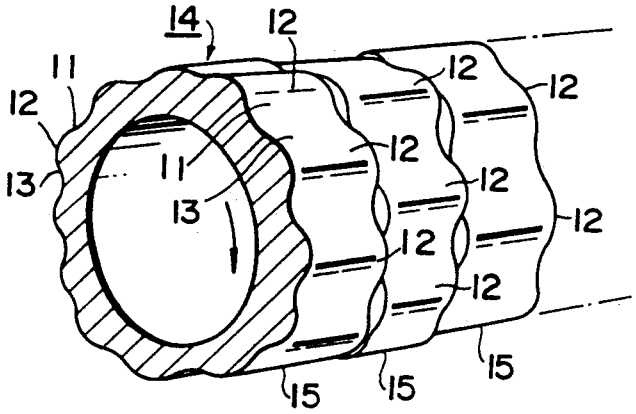
FIG. 5 is a perspective side view of a further embodiment of the rotor.

FIG. 5 shows an embodiment in which a rotor 14 is partitioned into plural processing zones 15 in the axial direction. The compressing section 11, shearing section 12 and expanding section 13 are continuously provided in the circumferential direction of the rotor 14 in each processing zone. The phases of adjacent sets of compressing sections 11, shearing sections 12 and expanding sections 13 at the processing zones 15 are angularly shifted relative to one another along the length of the rotor. According to this embodiment, as the material to be processed is transferred from an upstream processing zone to an adjacent downstream processing zone during processing, the flow of the material meets a resistance and moves mainly in the circumferential direction as a whole, thereby ensuring that the material is sufficiently processed.

Figure 6:
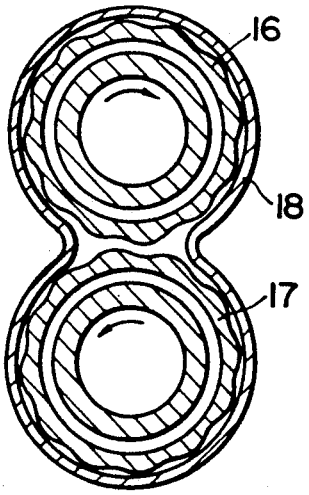
FIG. 6 is a cross-sectional view showing an embodiment having two rotors.

The rotors constructed as mentioned above may be provided in a plural number within the vessel. For example, as shown in FIG. 6, the apparatus may be constituted in such a manner that rotors 16, 17, like the rotor 5 shown in FIG. 4, are arranged in series within a vessel 18. By such an arrangement, the material to be processed flows back and forth between one rotor 16 and the other rotor 17, and the material is mainly moved in the circumferential direction as a whole resulting in sufficient processing of the material.

When the rotors 5, 14, 16 and 17 rotate, the material to be processed, which is fed with pressure into the vessel by use of a compressing-feeding means such as a pump or the like, is gradually compressed at the compressing section 11, then subjected to shearing forces between the shearing section 12 and the inner wall 6 of the vessel whereby the material is ground, then the compression of the material is released at the expanding section 13, then compressed again at the next compressing section 11, and then ground at the next shearing section 12, and so on. The material flows to the outlet 3 after the continuous processing by such actions, during which the material is finely ground to a desired size and uniform dispersion.

The surface of the rotor and the inner wall 6 of the vessel are preferably composed of abrasion resistance materials, for example, ultra rigid materials such as ceramic, tungsten carbide or the like.

It is preferable to design the apparatus so that the space between the rotor and the inner wall 6 of the vessel may be selectively varied depending on the properties of the materials to be processed. The adjustment of the space can be made by designing the apparatus in such a manner that the vessel and rotor are formed into a cone shape in which the diameters of the vessel and rotor vary from the inlet to the outlet, and either one or both of the vessel and rotor may be moved in the axial direction to adjust the dimensions of the space.

Figure 7:
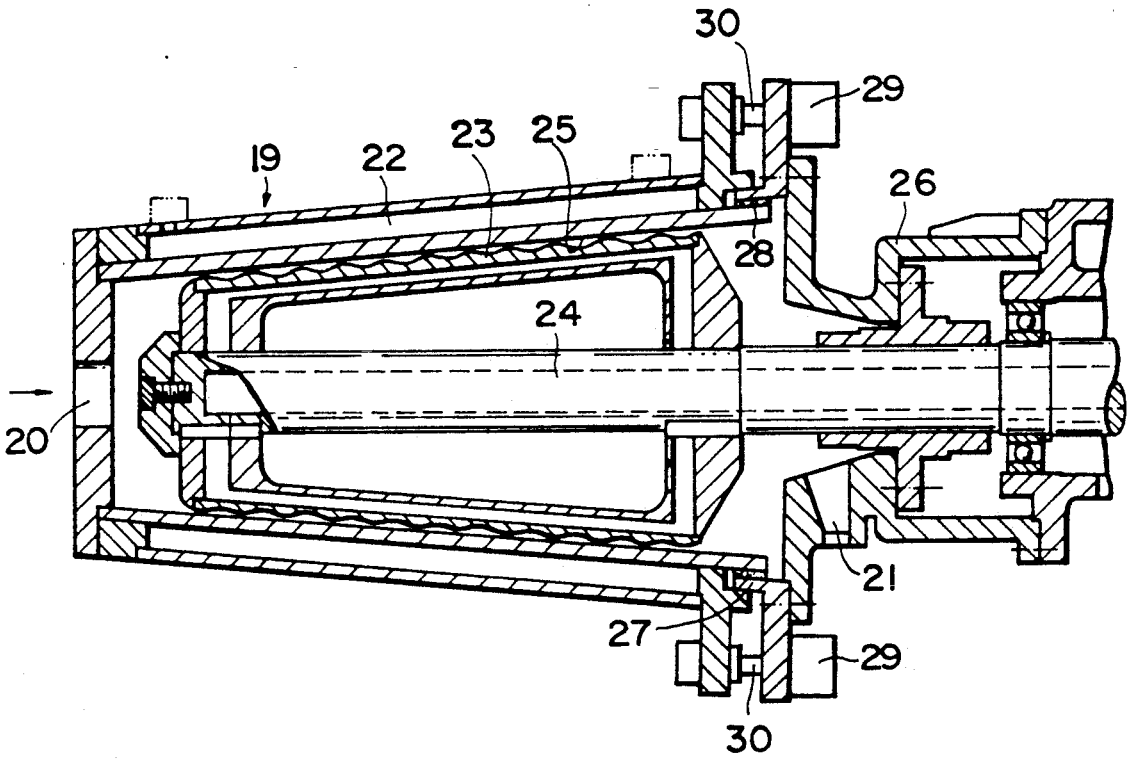
FIG. 7 is a vertical sectional view of another embodiment of a continuous dispersing apparatus according to the present invention, in which a vessel can be moved in an axial direction.

The embodiment shown in FIG. 7 shows an apparatus in which a vessel 19 is arranged to be shiftable in the axial direction. The vessel 19 has an inlet 20 at one end for feeding the material to be processed by a compressing-feeding means such as a pump or the like, and an outlet 21 at the other end. The vessel 19 has a jacket 22 for circulating a temperature-controlling medium such as cooling water or the like around the vessel 19, and a rotor 23 inside the vessel. The rotor 23 is rotated by a rotationally driven shaft 24. The inner wall 25 of the vessel 19 and the rotor 23 are formed into a cone shape whose diameter expands from the inlet 20 toward the outlet 21. Alternatively, the vessel and rotor may be formed into a cone shape having a diameter that reduces from the inlet to the outlet. On the rotor 23, a compressing section, a shearing section and an expanding section are continuously arranged as in the afore-described embodiments.

An inner end portion of the vessel 19 is slidably fitted to a flange 27 arranged at a stationary portion 26, and an appropriate sealing member 28, is provided at the sliding surface to permit the movement of the vessel 19 in the axial direction under a sealing condition.

Any suitable means of moving the vessel may be used. In the moving means shown in FIG. 7, a cylinder device 29, such as a hydraulic cylinder, a pneumatic cylinder or the like, is provided at the stationary portion 26, and a piston rod 30 of the cylinder device 29 is connected to the vessel 19. The vessel is moved in the axial direction by the extension and retraction of the piston rod by the operation of the cylinder device 29.

Figure 8:
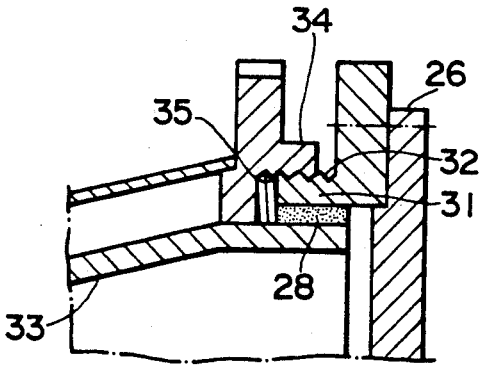
FIG. 8 is a vertical sectional view of a part of an end portion of a vessel of another embodiment in which the vessel can be moved.

The moving means shown in FIG. 8 uses a thread device. In this embodiment, a male thread 32 is arranged at a flange 31 formed on the stationary portion 26, and a female thread 35 is arranged on a flange 34 formed on a vessel 33. The flange 34 has gear teeth about its periphery for engagement with a rotationally driven gear (not shown). The vessel can be moved in the axial direction by rotationally driving the flange 34 to effect corresponding rotation of the vessel 33.

Figure 9:
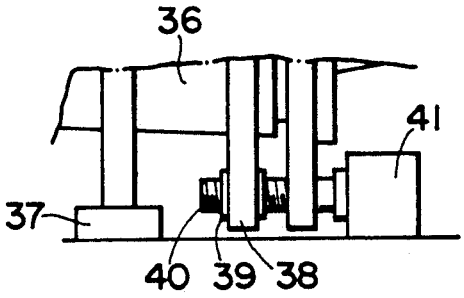
FIG. 9 is a front view of an end portion of a vessel showing a further embodiment in which the vessel can be moved.

FIG. 9 shows an embodiment using another thread device. In this embodiment, a vessel 36 is supported by a supporting member 37 and positioned transversely. A flange 38 is connected to the vessel 36 and carries a nut 39. A feed screw 40 is threadedly engaged with the nut 39. By rotating the feed screw 40 by an actuator 41 including a motor, a speed reducer or the like, the vessel 36 is moved in the axial direction. Here, if the vessel 36 is positioned in a vertical direction, the supporting member 37 is not necessary.

Alternatively, in the FIG. 7 embodiment, the rotor 23 can be moved by providing an appropriate moving means for moving the rotor in the axial direction at one end of the rotor 24.

According to the above construction, the rotor and the vessel are initially moved axially to separate from each other to enlarge the distance between the compressing, shearing and expanding sections and the inner wall of the vessel so that the start of the operation can be made easily even if the material to be processed has a high viscosity. Once the rotor starts to rotate, the vessel and rotor may be moved closer together to adjust the distance to a suitable value to effect processing of the material.

In the embodiments mentioned above, the vessels and rotors are arranged transversely. It is understood that the vessels and rotors may also be arranged in the vertical direction or an oblique direction.

In accordance with the present invention, the material to be processed is ground every time it passes through one of the shearing sections, and the material is processed continuously by this action during its travel from the inlet to the outlet. Accordingly, the dispersing efficiency of the material is extremely high. Further, since the processing can be carried out continuously in a sealed system, problems resulting from escape of solvent vapor or the like can be eliminated. Even if the material to be processed has a high viscosity, the problem in starting can be solved by adjusting the space at the shearing sections. Also the surface of the rotor and the inner wall of the vessel are not brought into contact with each other so as to prevent seizing.

We claim:

1. A continuous dispersing apparatus comprising: a vessel having an inlet for admitting a material to be processed at an upstream end and an outlet for discharging the processed material at a downstream other end; and a rotor rotatably disposed within the vessel and spaced from the inner wall of the vessel to define therebetween a path for the material, the surface of the rotor having along the length thereof a repeating pattern of a compressing section formed in such a manner that a space between the compressing section and the inner wall of the vessel becomes narrower gradually so that the material may be compressed when the material flows from the inlet to the outlet through the path between the rotor and the vessel, a shearing section downstream of the compressing section and opposite to the inner wall with a narrow space therebetween so that shearing forces may be applied to the material between the shearing section and the inner wall, and an expanding section downstream of the shearing section and formed in such a manner that a space between the expanding section and the inner wall becomes wider gradually so that the compression to the material may be released downstream of the shearing section.

2. A continuous dispersing apparatus according to claim 1; wherein the compressing section, shearing section and expanding section are continuously arranged in a wave shape in an axial direction of the rotor.

3. A continous dispersing apparatus comprising: a vessel having an inlet for admitting a material to be processed at an upstream end and an outlet for discharging the processed material at a downstream end, the inner diameter of the vessel increasing from one end toward the other end; a rotor rotatably disposed within the vessel and having a diameter which increases from one end toward the other end along an inner wall of the vessel, a peripheral face of the rotor being provided with a continuously repeating pattern of a compressing section formed in such a manner that a space between the compressing section and the inner wall of the vessel becomes narrower gradually so that the material may be compressed, a shearing section disposed opposite to the inner wall with a narrow space therebetween so that shearing forces may be applied to the material between the shearing section and the inner wall, and an expanding section formed in such a manner that a space between the expanding section and the inner wall becomes wider gradually so that the compression to the material may be released subsequent to the shearing section; and moving means for moving the vessel in an axial direction relative to the rotor.

4. A continuous dispersing apparatus according to claim 3; wherein the moving means comprises a cylinder device.

5. A continuous dispersing apparatus according to claim 3; wherein the moving means comprises a thread device.

6. A continuous dispersing apparatus according to claim 3; wherein the vessel is slidably fitted to a stationary member supporting the rotor.

7. A dispersing apparatus comprising: a vessel for receiving a material to be processed, the vessel having an inlet at an upstream end thereof for admitting the material into the vessel and an outlet at a downstream end thereof for discharging processed material from the vessel; and a rotor mounted to undergo rotation within the vessel and being positioned relative to the vessel to define an annular flow path between an inner wall of the vessel and an outer surface of the rotor, the outer surface of the rotor being provided with undulations having alternate crests and troughs which define a repeating pattern of compressing, shearing and expanding sections disposed in succession along the rotor for successively compressing, shearing and expanding the material as the material flows through the flow path between the vessel inner wall and the rotor undulations, each pattern comprising a compressing section sloping gradually toward the vessel inner wall in the direction of material flow and cooperating with the inner wall to compress the material, a shearing section downstream of the compressing section and opposed to the vessel inner wall with a narrow space therebetween to apply shearing forces to the compressed material which flows through the narrow space, and an expanding section downstream of the shearing section and sloping gradually away from the vessel inner wall in the direction of material flow and cooperating with the inner wall to relieve the compression of the material.

8. A dispersing apparatus according to claim 7; including a plurality of similar rotors disposed in parallel within the vessel and spaced from the inner wall of the vessel to define therebetween a continuous annular flow path which encircles all of the rotors.

9. A dispersing apparatus according to claim 7; including heat exchanging means disposed interiorly of the rotor for controlling the temperature of the material being processed through indirect heat exchange.

10. A dispersing apparatus according to claim 7; including heat exchanging means disposed interiorly of the vessel for controlling the temperature of the material being processed through indirect heat exchange.

11. A dispersing and grinding apparatus according to claim 7; wherein the opposed surfaces of the rotor and vessel are conically tapered.

12. A dispersing and grinding apparatus according to claim 11; further comprising means for axially displacing the vessel relative to the rotor to vary the dimension of the flow path.

13. A dispersing apparatus according to claim 7; wherein the rotor has a rotor plate member at its downstream end, and the vessel has a stator plate member facing the rotor plate member to form a narrow gap therebetween for preventing the free outflow of the material through the outlet.

14. A dispersing apparatus according to claim 7; further comprising force-applying means for applying a force to the rotor in a direction opposite to the flowing direction of the material to be processed.

15. A dispersing apparatus according to claim 7; wherein the inner wall of the vessel is free of undulations at least in the region thereof opposite the repeating pattern of compressing, shearing and expanding sections of the rotor.

16. A dispersing apparatus according to claim 1; wherein the inner wall of the vessel is free of undulations at least in the region thereof opposite the repeating pattern of compressing, shearing and expanding sections of the rotor.

17. A dispersing apparatus according to claim 3; wherein the inner wall of the vessel is free of undulations at least in the region thereof opposite the repeating pattern of compressing, shearing and expanding sections of the rotor.

* * * * *